United States Patent [19]

Spenceley

[11] 4,316,496

[45] Feb. 23, 1982

[54] CONTINUOUS CASTING OF METAL STRIP

[75] Inventor: Gene D. Spenceley, Stokesley, England

[73] Assignee: British Steel Corporation, London, England

[21] Appl. No.: 171,440

[22] Filed: Jul. 23, 1980

[30] Foreign Application Priority Data

Jul. 25, 1979 [GB] United Kingdom ..... 25990/79

[51] Int. Cl.[3] ..... B22D 11/06

[52] U.S. Cl. ..... 164/477; 164/263; 164/429; 164/324; 164/479

[58] Field of Search ..... 164/69, 70, 87, 88, 164/76, 262, 263, 269, 270, 417, 427–434, 322–324, 329–330

[56] References Cited

U.S. PATENT DOCUMENTS 3,281,903 11/1966 Ross ..... 164/88 X
3,703,204 11/1972 Brownstein ..... 164/87
3,964,963 6/1976 Anderson ..... 164/428

FOREIGN PATENT DOCUMENTS 1526192 9/1978 United Kingdom ..... 164/429
1551754 8/1979 United Kingdom ..... 164/429
1551755 8/1979 United Kingdom ..... 164/429
341582 7/1972 U.S.S.R. ..... 164/263

*Primary Examiner*—Robert D. Baldwin
*Assistant Examiner*—K. Y. Lin
*Attorney, Agent, or Firm*—Bacon & Thomas

[57] ABSTRACT

A ferrous feedstock for subsequent use in a melting or smelting furnace is produced by casting molten ferrous material continuously onto the surface of an elongate channel-shaped substrate moving continuously past a casting station. The cast material solidifies to form a strip which is separated continuously from the substrate and subsequently fragmented to produce ferrous segments of a size suitable for feeding to a melting or smelting furnace.

13 Claims, 5 Drawing Figures

CONTINUOUS CASTING OF METAL STRIP

This invention relates to the continuous casting of metal and more especially but not exclusively, to casting molten metal from a melting or smelting furnace into a strip form which can readily be fragmented for subsequent use as a feedstock, deoxidant, or alloying addition in, for example, a steel-making vessel.

Various proposals have been made previously for continuously casting metal strip. For example, in U.S. Pat. No. 3,703,204, there is disclosed the concept of casting molten metal into a horizontally moving channel-shaped mould of so-called ablative material, such as papier mâché, which is charred or burned on to the molten metal to form a mould surface during its solidification therein. It is also known to continuously cast molten metal into channel-shaped moulds lined with a non-sacrificial ceramic material.

In an integrated steel works, the furnace iron-making capacity is normally matched to the steel-making capacity of the steel works. Since it is often impracticable or uneconomic to manipulate the blast furnace output to meet fluctuating demands of the steel plant, there are occasions when the amount of iron produced by the blast furnace is greater than that required by the steel-making plant. Hitherto, any excess iron had been solidified by plating, pig casting and granulating techniques for subsequent use as a feedstock in a steelmaking vessel. These known techniques suffer from disadvantages consequent on low yield, high cost, contamination and size of the solidified product.

The present invention sets out to provide a cast product which can readily be fragmented to provide suitably sized segments for use as a feedstock in, for example, steel-making plant or for use as a deoxidation or alloying addition in such plant.

According to the present invention in one aspect, there is provided apparatus for producing a ferrous feedstock for subsequent use in a melting or smelting furnace, comprising a channel-shaped iron substrate movable in a generally horizontal direction continuously past a casting station, means at said casting station operable to cast molten ferrous material continuously onto said substrate to produce a solidified metal strip, means for separating the strip from the substrate and means for fragmenting the solidified strip into segments of a size suitable for use as a ferrous feedstock. The substrate is preferably of a thickness sufficient to extract heat from the cast strip to assist solidification thereof.

The metal cast continuously on to the substrate may comprise molten iron from an iron making vessel (e.g. a blast furnace) or molten steel from a steel-making vessel or molten ferro alloy from a melting unit (e.g. a blast furnace or smelting vessel). The cast product may be of a substantially uniform thickness (for example 25 mm) and may subsequently be grooved to facilitate subsequent fragmentation.

Alternatively, grooves may be cast into the strip product by virtue of the configuration of the substrate or may be formed into the upper surface of the strip as it solidifies by means of a roller having an indented surface rotatable in contact with the strip surface. Thus, the substrate may be formed with laterally and/or longitudinally extending grooves.

Coolant, e.g. water spray, may be directed onto the surface of the cast strip to assist solidification of the same.

According to the present invention in another aspect, there is provided a method of solidifying molten ferrous material from a melting or smelting furnace which comprises casting the molten ferrous material on to an elongate, horizontally moving channel-shaped cast iron substrate to produce a solidified strip, separating the solidifed strip from the substrate, and subsequently fragmenting the solidified strip into segments suitable for use as a feedstock in a metal refining or melting process.

In one application of the invention, the furnace comprises a blast furnace or an electrical smelting or melting furnace. The ferrous material may comprise molten iron, steel or ferro alloy, e.g. ferro manganese, ferro chrome, ferro silicon, ferro vanadium, ferro molybdenum, ferro boron or ferro titanium.

The invention will now be described by way of example with reference to the accompanying diagrammatic drawings in which.

Figure 1:
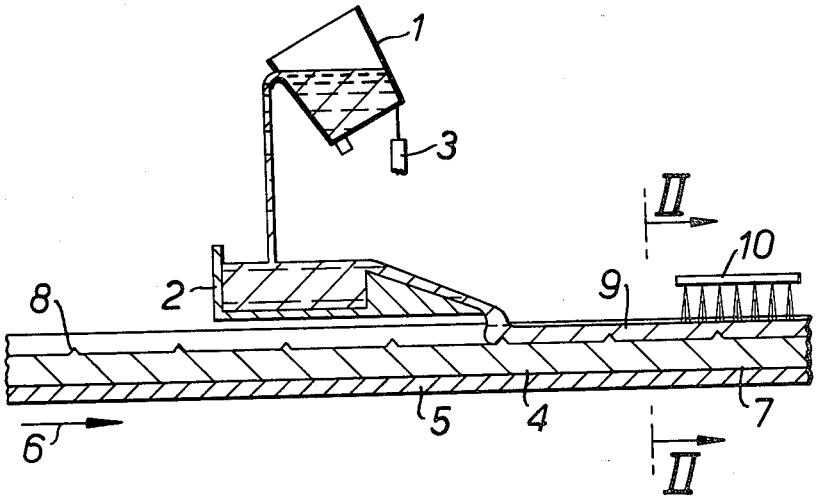
FIG. 1 is a diagrammatic, side elevational view in section of one embodiment of apparatus in accordance with the invention.

FIG. 1 schematically shows molten iron from a blast furnace being poured from a tiltable ladle 1 into a weir box 2 positioned above the strip casting apparatus. The rate at which the molten iron is delivered to the weir box is controlled by varying the angle of tilt of the ladle in dependence upon the weight of metal contained in the ladle as measured by load sensors 3 positioned below the ladle.

The casting apparatus comprises a channel-shaped cast iron substrate 4 carried upon a horizontally movable support system 5. The substrate 4 is formed with a series of regularly spaced longitudinally and laterally extending projections 8 and the direction of movement of the substrate 4 and that of the support system 5 is indicated by arrow 6.

Molten iron 9 cast on to the substrate 4 solidifies to form a strip product, having a grooved undersurface conforming to the upper surface of the substrate 4. Water sprays 10 are directed onto the upper surface of the cast strip to accelerate solidification. The solidified strip product is separated from the substrate 4 at a suitable position downstream of the weir 2 in a continuous manner.

The grooved substrate may be replaced after each casting operation or may be used for a given number of casts or until it develops an unacceptable geometry or surface. A surface coating (e.g. a lime wash) may be applied to the upper surface of the substrate before casting of the molten iron to assist separation of the solidified product from the mould. The projections 8 formed on the substrate are reflected in the cast produce and enable the cast iron strip to be readily fragmented into suitably sized segments for feeding to steelmaking and foundry plants, being particularly suitable for plant operating with continuous feeding equipment.

Figure 3A:
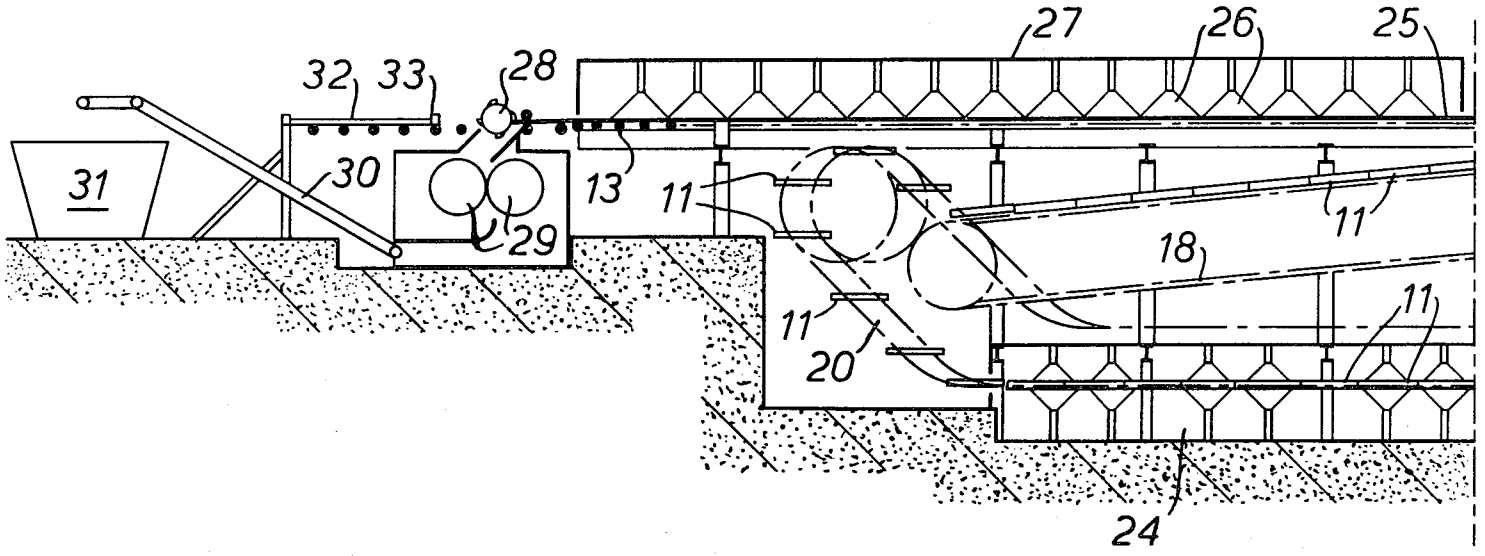
FIGS. 3A, 3B and 4 are, respectively, side elevational and plan views of further apparatus in accordance with the invention.
Figure 3B:
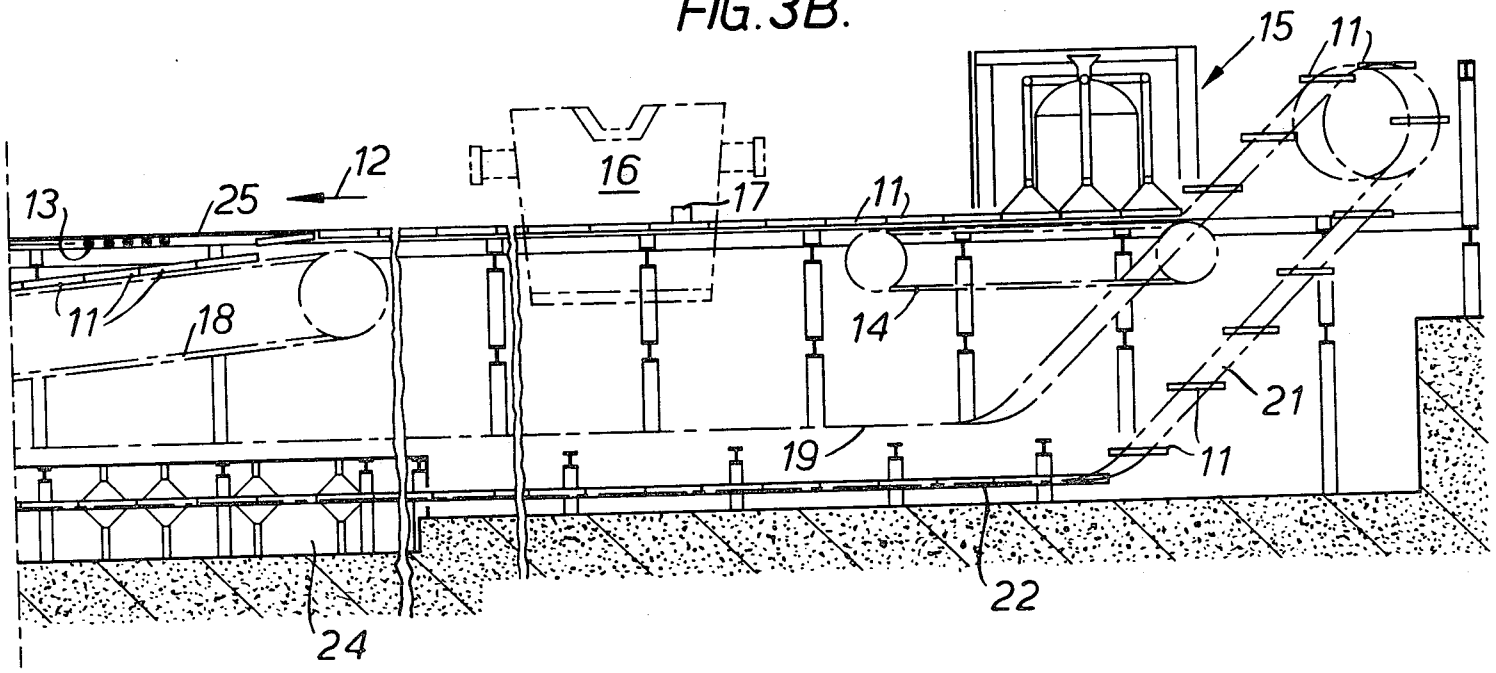
Figure 4:
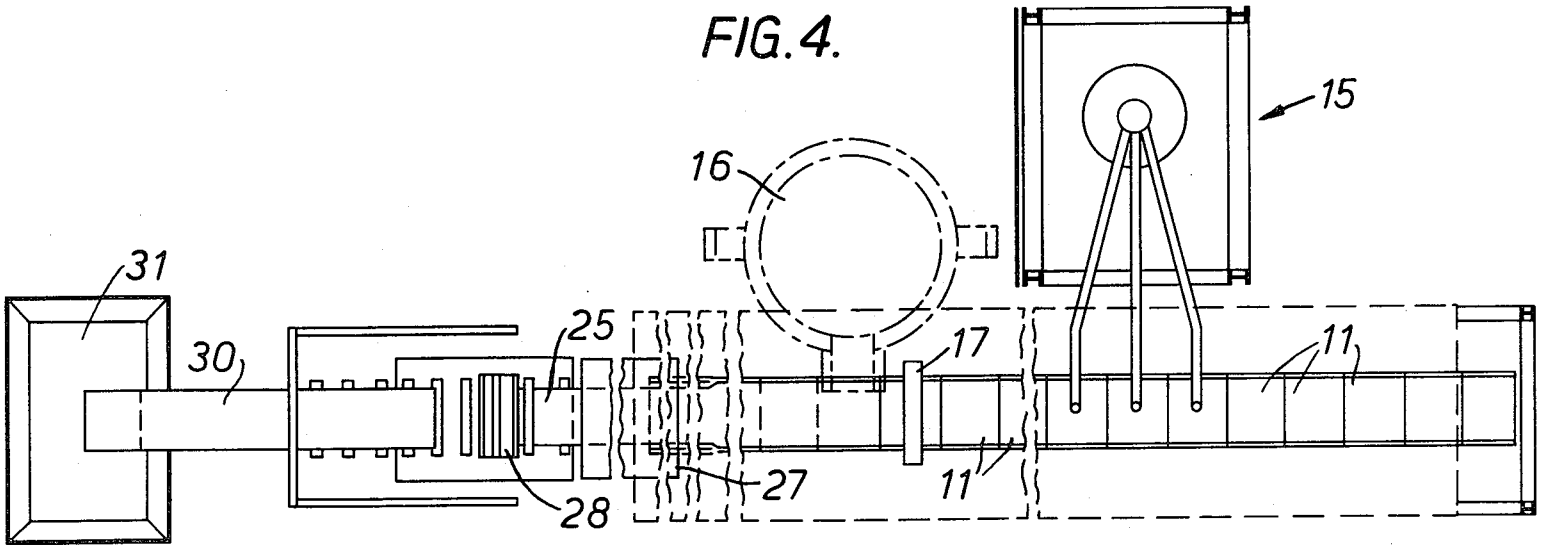

A more detailed embodiment of apparatus in accordance with the invention will now be described with reference to FIGS. 3 and 4. For the sake of clarity FIG. 3 has been divided into two parts FIGS. 3A and 3B respectively showing left- and right-hand sections of the complete apparatus. In this embodiment the substrate consists of a plurality of channel shaped cast iron mould segments 11 moved by a system of belts, rollers and chains continuously around an endless path. The direction of movement of the mould segments is indicated by arrow 12.

Figure 2:
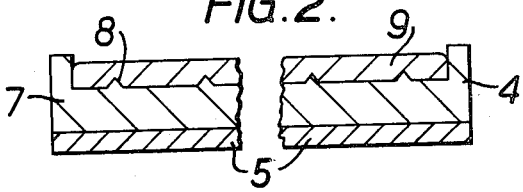
FIG. 2 is a section taken along line II—II of FIG. 1.

Essentially the individual mould segments have a crosssection similar to that illustrated in FIG. 2 although the projections 8 may not be present. Additionally, the individual mould segments are formed with side lugs and indentations (not shown) for purposes to be discussed below.

The upper flight of the endless path travelled by the mould segments comprises a general horizontal roller table 13. Positioned at the entry end of the roller table is a steel bushed roller chain conveyor 14 operable beneath the mould segments and between the adjacent rollers of the roller table to drive the mould segments along the table at a substantially constant speed. For this purpose the chain conveyor 14 is formed with pusher attachments (not shown) which co-operate with lugs or indentations formed in the mould segments. Thus over the entire length of the upper flight of the endless path adjacent mould segments are butted together to present a continuous substrate surface with no spacings between individual mould segments.

A spraying apparatus 15 for depositing a coating material, e.g. graphite, on to the upper surfaces of the mould segments is positioned above and to one side of the roller table at its entry end. As illustrated the spraying apparatus 15 comprises three nozzles connected to a common reservoir of coating material.

As the coated mould segments travel along the roller table 13 liquid metal from a casting ladle 16 is poured continuously on to the butted mould segments to form a continuous metal strand. In order to inhibit movement of liquid metal along the mould substrate surface in a direction counter to the direction of travel of the mould segments a graphite end bar 17 is positioned just upstream of the casting station. Thus as the individual mould segments approach the casting station they pass below the end bar the clearance being set at a predetermined distance dependent upon the required cast strip thickness.

The liquid metal may be cast on to the mould segments directly from the tilting ladle 16; alternatively, a weir box similar to that illustrated in FIGS. 1 and 2 or a stopper controlled tundish may be interposed between the ladle and the mould.

The cast liquid metal rapidly cools and solidifies within the cast iron mould segments, the segments being relatively massive so as to extract heat from the cast metal. At a location along the roller table sufficiently remote from the casting station to enable solidification to have taken place the solidified cast strip is stripped from the mould segments by means of a stripping conveyor 18. This conveyor comprises two spaced, endless strands of steel bushed roller conveying chains, each strand having carrier attachments (not shown) at a constant pitch. The stripping conveyor 18 collects each individual mould segment 11 by engagement of the carrier attachments with the mould segment lugs or indentations, conveys the segment off from the roller table 13, lowers the segment and transfers it down a shallow incline for subsequent transfer to a return conveyor 19. At its upper end the stripping conveyor 18 is arranged to operate beneath the mould segments within the segment width and between the adjacent rollers of the roller table 13.

The return conveyor 19 operates to return the mould segments from the stripping conveyor to the end of the roller table adjacent the spraying apparatus 15. The conveyor 19 again comprises two spaced, endless strands of steel bushed roller conveying chains and between which the mould segments are supported. The chain strands are equipped with extending bearing pins or similar attachments (not shown) for location in the indented sides of the mould segments.

The return conveyor 19 has inclined sections 20,21 respectively for transfer of the mould segments off from the stripping conveyor 18 and for reintroduction of the mould segments on to the roller support table 13.

As each mould segment travels along the lower flight of its endless path it is additionally supported on a gravity roller track 22. As the mould segments travel along the roller track 22 their upper and lower surfaces are cooled by water sprays 24.

The conveyors 14, 18 and 19 are driven from one main drive motor and reduction gear unit (not shown) via constant speed layshaft and final chain drives of the required ratios to the respective conveyor driving wheels. The drive for the stripping conveyor 18 is derived from the tail wheel shafts of the return conveyor 19 by the inclusion of 1:1 ratio final chain drives.

Following stripping of the mould segments 11 from the solid cast strip by the conveyor 18, the cast strip 25 continues its generally horizontal travel along the roller table 13 and is further cooled by coolant sprays 26 with a spray chamber 27. The fully solidified strip is then broken-up into segments of the required size and shape by a rotary hammer 28 and crushing rolls 29, the segments then being transferred via a conveyor 30 into a container 31.

At the left-hand end of the roller table a starter strip 32 having a graphite end bar 33 is illustrated. On first pouring on liquid metal into the mould segments, the starter strip 32 is positioned with its end bar 33 just downstream of the casting station. The bar 33 prevents excessive movement of liquid metal along the mould surface to control initial strip thickness. The starter strip moves along the roller table in advance of the solidifying strip and travels to the position shown, the hammer roll 28 being raised for this purpose.

Burners may be provided to preheat the starter bar and individual mould segments before liquid metal is first cast onto the mould surfaces. Conveniently, the burners for preheating the mould segments are positioned to preheat the individual mould segments as they approach the entry end of the roller table 13.

It is to be appreciated that the foregoing is specific to one particular embodiment of casting apparatus and that the apparatus described is capable of various changes and modifications.

I claim:

1. Apparatus for producing a ferrous feedstock for subsequent use in a melting or smelting furnace comprising a multiplicity of abutting separable and independent channel shaped mould segments, means operable to drive such mould segments continuously about an endless path which includes a generally horizontal upper flight and a vertical displaced lower flight such drive means comprising a member positioned at the upstream end of such horizontal upper flight and movable into engagement with a complementary part of an adjacent mould segment to drive such segment along the upper flight so as to present a continuous substrate surface with no spacings between individual mould segments, a casting station operable to cast molten ferrous material continuously on to said upper flight of said substrate surface to produce on cooling a solidified ferrous strip, means for stripping such strip from the substrate and for transferring said separable and independent channel shaped mould segments to said vertical displaced lower flight, means for returning said separable and independent channel shaped mould segments from said vertical displaced lower flight to said generally horizontal upper flight and means for fragmenting the solidified strip into segments of a size suitable for use as a ferrous feedstock.

2. Apparatus as claimed in claim 1 wherein the upper flight of mould segments is supported upon a horizontal roller table, said drive means comprising a chain conveyor which co-operates with lugs formed in the mould segments.

3. Apparatus as claimed in claim 1 wherein the substrate is of a thickness sufficient to extract heat from the cast strip to assist solidification thereof.

4. Apparatus as claimed in claim 1 wherein the surface of the substrate is formed with a series of regularly spaced projections.

5. Apparatus as claimed in claim 4 wherein the projections extend both laterally across and longitudinally along the width and length respectively of the substrate.

6. Apparatus as claimed in claim 1 wherein the substrate surface is coated with a protective material in advance of the casting station.

7. Apparatus as claimed in claim 6 wherein the substrate surface is coated with graphite.

8. Apparatus as claimed in claim 1 wherein cooling means are positioned adjacent the lower flight of the endless path to cool the mould segments as they are being returned to the entry end of the upper flight.

9. Apparatus as claimed in claim 1 wherein the fragmenting means comprises a rotary hammer positioned in-line with the path taken by the solidified strip after separation from the substrate.

10. A method of producing a fragmented feedstock comprising the steps of continuously casting molten material from a casting station on to a channel shaped substrate surface consisting of a multiplicity of abutting separable and independent channel shaped mould segments moving in a generally horizontal path continuously past the casting station to produce a solidified metal strip, separating the solidified strip from the substrate, transferring said separable and independent channel shaped mould segments from said generally horizontal path to a vertical displaced path, returning said separable and independent channel shaped mould segments to said generally horizontal path and fragmenting the solidified strip separated from said substrate into fragments of a size suitable for use as the required feedstock.

11. A method as claimed in claim 10 wherein the substrate is relatively massive so as to extract heat from the cast strip to assist solidification thereof.

12. A method as claimed in claim 10 wherein grooves are cast into the strip product by virtue of the configuration of the substrate.

13. A method as claimed in claim 10 wherein grooves are formed into the upper surface of the strip as it solidifies by means of a roller having an indented surface rotatable in contact with the strip surface.

* * * * *